US007824121B2

(12) United States Patent
Ramet et al.

(10) Patent No.: US 7,824,121 B2
(45) Date of Patent: Nov. 2, 2010

(54) PACKAGING AND APPLICATOR DEVICE

(75) Inventors: Marc Ramet, Asnieres (FR); Daniel Crosnier, Offranville (FR); Christiane Crosnier, legal representative, Offranville (FR)

(73) Assignee: L'Oreal, Paris (FR)

( * ) Notice: Subject to any disclaimer, the term of this patent is extended or adjusted under 35 U.S.C. 154(b) by 1141 days.

(21) Appl. No.: 11/398,657

(22) Filed: Apr. 6, 2006

(65) Prior Publication Data

US 2007/0009314 A1 Jan. 11, 2007

Related U.S. Application Data

(60) Provisional application No. 60/691,773, filed on Jun. 20, 2005.

(30) Foreign Application Priority Data

Apr. 18, 2005 (FR) ..... 05 50979

(51) Int. Cl.
*A46B 17/08* (2006.01)

(52) U.S. Cl. ..... 401/122; 401/129; 401/121; 401/118

(58) Field of Classification Search ..... 401/118, 401/119, 121–130, 171, 179, 176
See application file for complete search history.

(56) References Cited

U.S. PATENT DOCUMENTS 4,929,108 A * 5/1990 Gueret ..... 401/122
4,984,918 A * 1/1991 Iizuka et al. ..... 401/122
5,052,837 A * 10/1991 Iizuka et al. ..... 401/122
5,192,153 A 3/1993 Gueret
5,636,931 A * 6/1997 Gueret ..... 401/126
6,082,918 A * 7/2000 Gueret ..... 401/126

FOREIGN PATENT DOCUMENTS

| | | |
|---|---|---|
| EP | 0 349 407 A1 | 1/1990 |
| EP | 0 350 535 A2 | 1/1990 |
| EP | 0 465 278 A1 | 1/1992 |
| EP | 0 931 476 A1 | 7/1999 |

* cited by examiner

*Primary Examiner*—David J. Walczak
*Assistant Examiner*—Keegan Gumbs
(74) *Attorney, Agent, or Firm*—Oliff & Berridge, PLC

(57) ABSTRACT

A packaging and applicator device may include a receptacle for containing a composition to be applied and an applicator including an applicator element that is configured to be inserted into the receptacle for taking the composition. The receptacle may include a body and a movable system that is movable inside the body. The movable system may include a wiper member that includes only one opening through which the applicator element passes while the applicator element is being inserted into the receptacle, the movable system being configured so as to move in a generally unidirectional manner toward a bottom of the receptacle under an effect of a force exerted by the applicator while the applicator is being inserted into the receptacle.

24 Claims, 8 Drawing Sheets

PACKAGING AND APPLICATOR DEVICE

CROSS-REFERENCE TO RELATED APPLICATIONS

This non provisional application claims the benefit of French Application No. 05 50979 filed on Apr. 18, 2005, and U.S. Provisional Application No. 60/691,773 filed on Jun. 20, 2005, the entire disclosures of which are incorporated herein by reference.

The present invention relates to a packaging and applicator device comprising a receptacle for containing a composition to be applied, and an applicator including an applicator element that is configured to be inserted into the receptacle for taking the composition contained therein.

BACKGROUND

European patent application EP 0 350 535 describes a device in which an open-worked scraper member is movable inside the body of the receptacle, in such a manner as to move upward and downward, respectively, while the applicator element is being removed from the receptacle, and while the applicator element is being put back in. This makes it easier to empty the receptacle, by ensuring that any composition that sticks to the body of the receptacle can be taken by the applicator element. A wiper member is provided in a top portion of the receptacle to scrape the stem of the applicator.

SUMMARY

There exists a need to improve still further a device of the kind discussed above.

Exemplary embodiments of the invention may satisfy that need.

Exemplary embodiments of the include invention provide a packaging and applicator device comprising: a receptacle for containing a composition to be applied; and an applicator including an applicator element that is configured to be inserted into the receptacle for taking the composition; the receptacle comprising: a body; a movable system that is movable inside the body, the movable system including a wiper member that includes an opening through which the applicator element passes while the applicator element is being inserted into the receptacle, the movable system being configured in such a manner as to be capable of moving toward a bottom of the receptacle under an effect of a force exerted by the applicator, for example, while the applicator element is being put back into the receptacle.

Advantageously, in exemplary embodiments, the wiper member does not include any opening other than the opening through which the applicator element passes.

Thus, the applicator element may take substantially a same quantity of composition each time the applicator element is removed from the receptacle, thereby improving reproducibility of makeup results.

In exemplary embodiments, the movable system may make it possible to reduce a risk of the composition drying out, and also may make it possible to concentrate the composition around the applicator element.

In exemplary embodiments, the inclusion of only one opening in the wiper member may make it possible to create, in an inside space of the receptacle containing the composition, suction that opposes rising of the wiper member.

In exemplary embodiments, the movable system may advantageously be configured so as to move in a generally unidirectional manner toward the bottom of the receptacle under the effect of a force exerted by the applicator, for example, while the applicator is being put back into the receptacle.

Because of the generally unidirectional displacement of the movable system, and thus of the wiper member, the movable system may move down inside the body of the receptacle, simultaneously and proportionately, for example, as the body empties, such that the receptacle does not allow the product or a relatively slight quantity of the product above the movable system, and the need to provide a stationary wiper member in the top portion of the receptacle may be avoided if so desired.

In exemplary embodiments, the device may be made without any wiper member other than the movable system. The use of a wiper member that does not include any opening other than the opening through which the applicator element passes may also reduce a risk of composition flowing beyond the wiper member, for example, when the receptacle is stored on its side for a long period of time.

In exemplary embodiments, the movable system may be prevented from rising in the receptacle, for example, under an effect of suction created while the applicator is being removed, by ensuring that the wiper member is in a sufficiently leaktight contact both with the stem of the applicator and the body of the receptacle.

In exemplary embodiments, the movable system may include an anti-return mechanism that interacts with the body of the receptacle so as to oppose rising of the movable system.

For example, the anti-return mechanism may comprise at least one blocking element that bears against the body of the receptacle with a coefficient of friction that is smaller while the movable system is moving toward the bottom of the receptacle, than while the movable system is moving in an opposite direction. For example, the anti-return mechanism may operate to jam at least one portion of at least one blocking element.

In exemplary embodiments, the blocking element may comprise a portion that is stationary relative to the wiper member, or, alternatively, the blocking element may comprise a portion that may be moved as a whole relative to the wiper member, for example, between a first position that enables the movable system to move downward, and a second position that opposes upward movement of the movable system.

For example, the blocking element may include at least one lip or tab that bears against the body of the receptacle, and that slopes outward, away from the bottom of the receptacle. The blocking element may include a plurality of such tabs, for example. The lip or the tab(s) may be carried by a washer, for example, that is fitted on the wiper member, for example. For example, the washer may be stationary relative to the wiper member.

In exemplary embodiments, the blocking element may also be configured to become wedged between the wiper member and the body of the receptacle, while the movable system is trying to rise. For example, the blocking element may comprise at least one ball that is configured to come to bear against the body and against a ramp of the movable system while the movable system is trying to rise in the body of the receptacle, the ramp sloping inward, away from the bottom of the receptacle. The blocking element may also comprise at least one angled portion that is configured to become wedged between the body of the receptacle and the wiper member while the movable system is trying to rise, the portion being made integrally, i.e., monolithically, with the wiper member, for example, and being connected to the wiper member by a flexible material bridge.

For example, the wiper member may include at least three, or even four, angled portions that are distributed uniformly about an axis of the wiper member, and that are each connected to a respective flexible material bridge that is connected to the body of the wiper member.

In exemplary embodiments, the wiper member may be made integrally, i.e., monolithically, with at least one lip or tab that bears against the body of the receptacle, the lip or tab being capable of flexing freely while the movable system moves toward the bottom of the receptacle, but being prevented from flexing in the opposite direction by the wiper member.

It is also possible for the movable system not to include an anti-return mechanism. For example, it may be the applicator that causes the movable system to move in a generally unidirectional manner toward the bottom of the receptacle. For example, it may be the friction of the movable system against the body of the receptacle that opposes rising of the movable system.

Suction that is created inside the receptacle, below the wiper member, while the applicator is being removed may also oppose rising of the wiper member.

Regardless of whether or not there is an anti-return mechanism, the movable system, for example, the wiper member, may include at least one portion in relief that is configured, while being passed over by the applicator, to deliver an opposing force that is greater while the applicator is being put back into the receptacle, than while the applicator is being removed. The force exerted by the applicator on the movable system while the applicator is being put back into the receptacle may be greater than a friction force existing between the movable system and the body of the receptacle, thereby moving the movable system closer to the bottom of the receptacle. The friction force between the movable system and the body of the receptacle may be greater than the force exerted by the applicator on the movable system while the applicator is being removed, such that, during removal, the movable system moves little, if at all.

For example, the portion in relief may be formed on the wiper member, and, for example, the wiper member may include a plurality of portions in relief that are angularly distributed uniformly about the axis of the opening through which the applicator element passes. For example, each portion in relief may include two surfaces including different inclinations; so that the wiper member may be passed over more easily while the applicator is being removed from the receptacle, than while the applicator is being put back therein.

In exemplary embodiments, the stem need not have a particular arrangement for co-operating with the movable system. Alternatively, the stem may include at least one portion in relief that is configured to co-operate with the movable system in such a manner that the force exerted by the applicator on the movable system is greater while the applicator is being put back into the receptacle, than while the applicator is being removed.

For example, the stem may include at least one annular lip that is oriented toward a free end of the applicator, i.e., toward the bottom of the receptacle when the applicator is in place in the receptacle.

In exemplary embodiments, the stem may also include at least one shoulder that may be surmounted by a ramp that slopes inward away from the applicator element.

In exemplary embodiments, the wiper member may bear against the body of the receptacle via at least two axially spaced-apart peripheral portions, without bearing against the body between the two portions. For example, the wiper member may include two annular lips that bear against the body, and that are oriented respectively toward the bottom and toward the opening of the receptacle, the two lips forming an outwardly-concave annular groove therebetween.

In exemplary embodiments, the wiper member may include a downwardly-open annular groove, which may be formed, for example, between a lip of the wiper member that bears against the body of the receptacle, and a central portion of the wiper member that defines the opening through which the applicator element may pass.

In exemplary embodiments, the applicator may include a movable portion that is configured to move away from the applicator element against an action of a return member. The movable portion may be configured to come to bear against the movable system. Thus, while the applicator is being inserted into the receptacle, the movable portion may come to bear against the movable system, and may move the movable system toward the bottom of the receptacle as the receptacle empties.

Regardless of the way in which the movable system is made, the bottom portion of the receptacle may include a well of inside cross-section that matches the applicator element, for example, of inside cross-section that is substantially equal to, or slightly greater than, the cross-section of the envelope surface of the applicator element. The well may be connected to a cylindrical wall of the body of the receptacle, along which the movable system slides, via a wall that flares away from a frustoconical bottom of the receptacle, for example, a frustoconical wall.

Exemplary embodiments of the include invention provide a packaging and applicator device comprising: a receptacle for containing a composition to be applied; and an applicator including an applicator element that is configured to be inserted into the receptacle for taking the composition; the receptacle comprising: a body, a movable system that is movable inside the body, the movable system including a wiper member that includes an opening through which the applicator element passes while the applicator element is being inserted into the receptacle, the movable system being configured to move in a generally unidirectional manner toward the bottom of the receptacle under an effect of a force exerted by the applicator, for example, while the applicator is being put back into the receptacle.

In such exemplary embodiments, the opening through which the applicator element passes may optionally be the only opening.

Exemplary embodiments of the include invention provide a packaging and applicator device comprising: a receptacle for containing a composition to be applied; and an applicator including an applicator element that is configured to be inserted into the receptacle for taking the composition; the receptacle comprising: a body; a movable system that is movable inside the body, the movable system including a wiper member that includes an opening through which the applicator element passes while the applicator element is being inserted into the receptacle, the movable system being configured to move toward the bottom of the receptacle under an effect of a force exerted by the applicator, for example, while the applicator is being put back into the receptacle.

In such exemplary embodiments, the device may not include any wiper member other than the movable system.

BRIEF DESCRIPTION OF THE DRAWINGS

Various details of the present invention may will be better understood on reading the following detailed description of non-limiting embodiments, and on examining the accompanying drawings, in which.

DETAILED DESCRIPTION OF EMBODIMENTS

Figure 1:
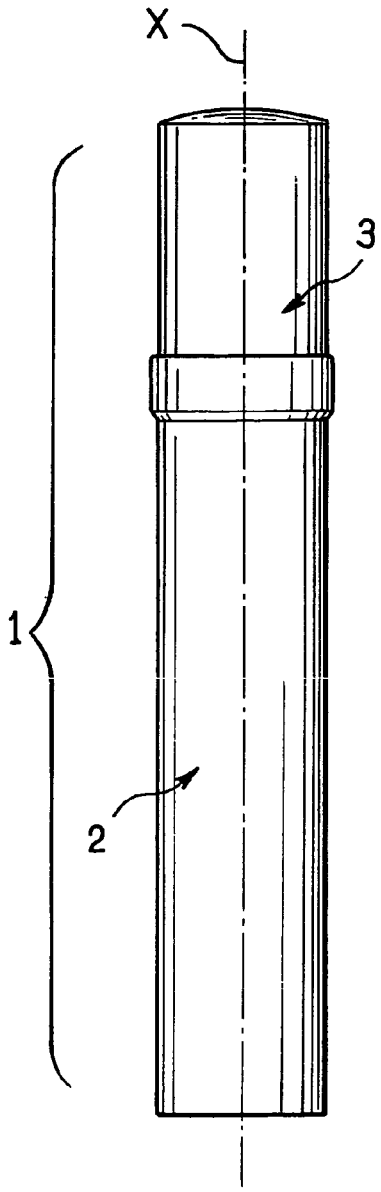
FIG. 1 is a diagram in elevation illustrating an exemplary a device.
Figure 2:
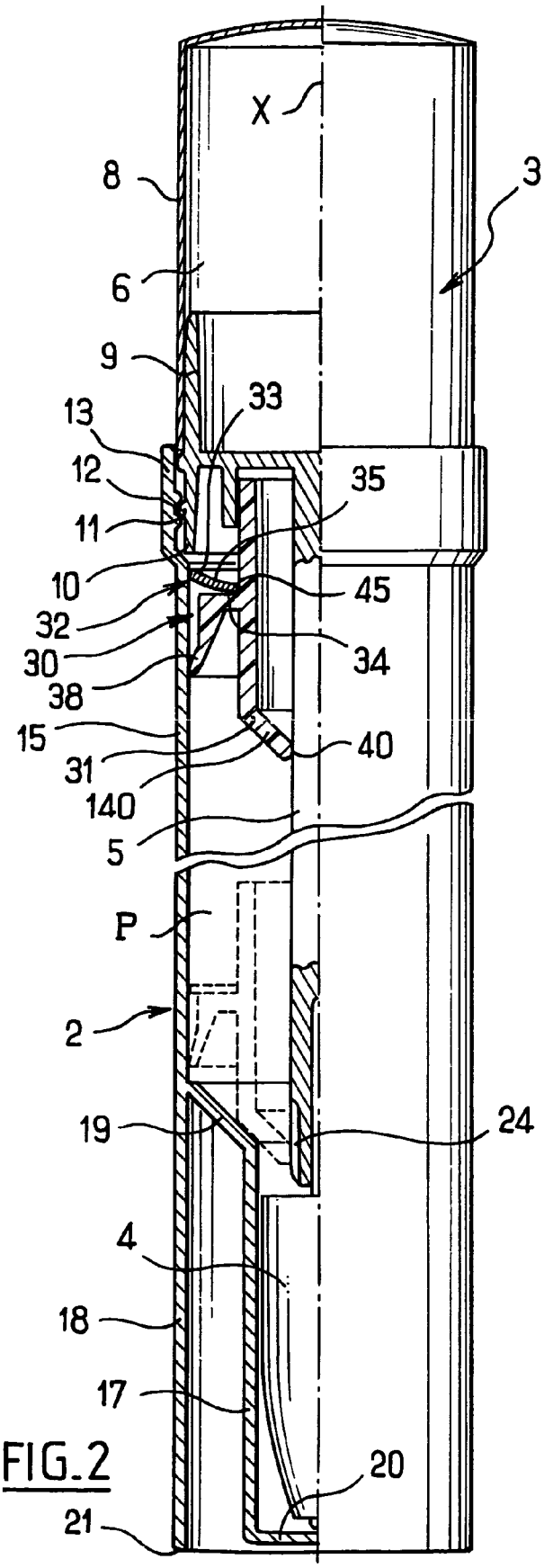
FIG. 2 is a fragmentary and diagrammatic longitudinal half-sectional view of the device of FIG. 1.

The exemplary device 1 illustrated in FIGS. 1 and 2 may comprise a receptacle 2 containing a composition P to be applied, and an applicator 3 including an applicator element 4 for taking the composition P contained in the receptacle, and for applying the composition to the human body.

In the exemplary embodiment, the applicator element 4 may comprise a mascara brush comprising a twisted metal core, with bristles held between turns of the core. However, the invention is not limited to a particular applicator element, and, for example, the applicator element may be of any type that makes it possible to apply composition to skin, lips, hair, and/or nails.

For example, and in exemplary embodiments not illustrated, the applicator element 4 may comprise: an endpiece that is optionally flocked, and that is optionally elastically deformable; a foam; a felt-tip; a brush of the paint-brush type; or a brush that does not include a metal core, for example, a brush or a comb made of an injection molded plastics material.

Other than the applicator element 4, the applicator 3 may comprise a stem 5 that includes an end remote from the applicator element 4 that is connected to a handle 6 that also comprises a closure member for closing the receptacle in a sealed manner.

In the exemplary embodiment, the handle 6 may include an external cap 8, for example, a metal cap. A top of the stem 5 may include a support skirt 9 that is secured inside the cap 8.

The support skirt 9 may be extended downwardly by an assembly skirt 10 that is used to fasten the handle 6 onto the receptacle 2.

For example, and as illustrated, fastening may be performed by snap-fastening, the assembly skirt 10 being configured to include a bead 11 that becomes snap-fastened in an annular groove 12 formed in the top portion of the receptacle 2, inside a widened opening 13 to the receptacle, for example.

In the exemplary embodiment, the receptacle 2 may comprise a cylindrical body 15 of axis X, for example, of circular cross-section, that is connected at a top thereof to the widened opening 13.

The axis X may also correspond to the longitudinal axis of the receptacle.

The bottom portion of the body 15 may be closed by a well 17 that is configured to house the applicator element 4 when the applicator 3 is in place in the receptacle 2. In the embodiment illustrated, an inside diameter of the well 17 may correspond substantially to an outside diameter of the applicator element.

The body 15 may be extended downwardly, around the well 17, by an outer skirt 18. The well 17 may be connected to the body 15 via a frustoconical wall 19 that flares upwardly. The bottom 20 of the well 17 may be situated set back a little from the bottom end 21 of the outer skirt 18.

Figure 5:
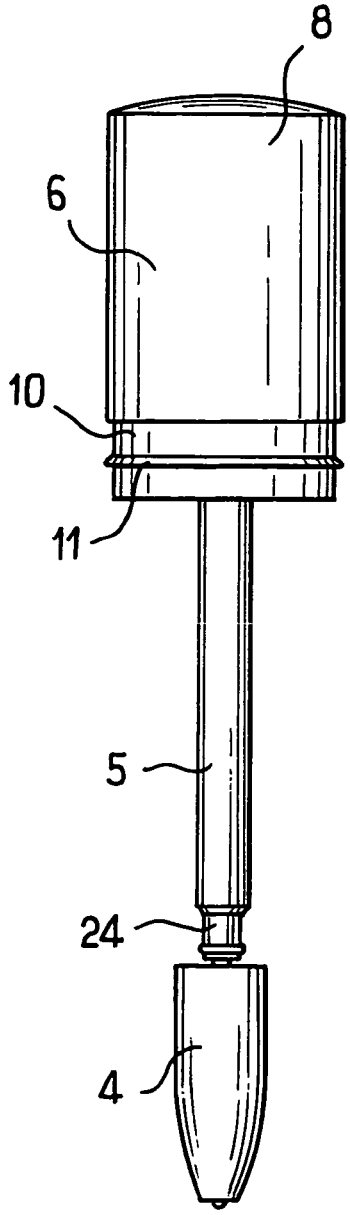
FIG. 5 illustrates the applicator of the device of FIG. 1, in isolation.

In the exemplary embodiment, and as illustrated in FIG. 5, the stem 5 may include an annular groove 24 at a bottom end thereof.

The device 1 may include a movable system 30 that may move in a generally unidirectional manner toward the bottom 20.

The movable system 30 may comprise a wiper member 31, and an anti-return mechanism 32, that, in the exemplary embodiment, may comprise an elastically deformable washer 45 that is fitted on the wiper member 31, and that may rest against a shoulder 46 of the wiper member 31 via a bottom face 35 thereof.

Figure 3:
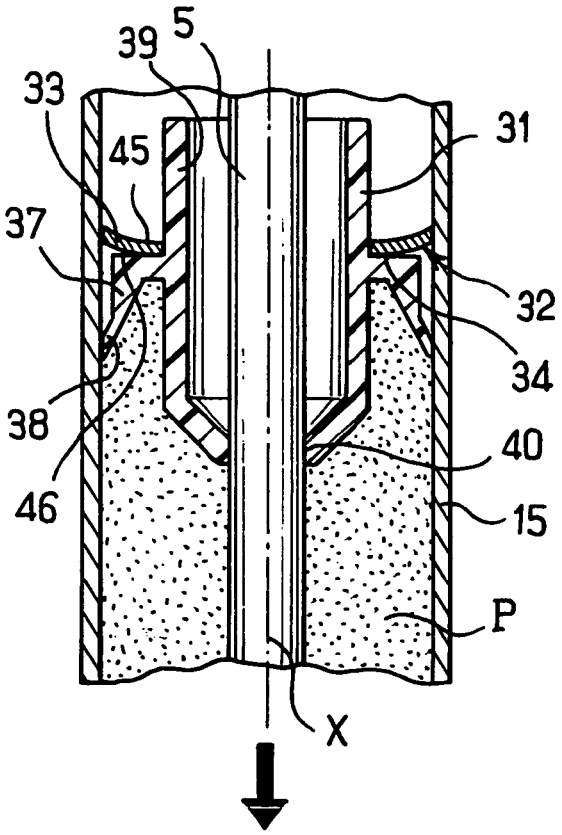
FIG. 3 illustrates displacement of the movable system toward the bottom of the receptacle while the applicator is being put back into the receptacle.

At a periphery thereof, the washer 45 may include an annular lip 33 that may flex upwardly while the wiper member 31 is moving downwardly, as illustrated in FIG. 3.

The wiper member 31 may include an annular peripheral portion 37 that includes a downwardly-directed lip 38 that bears in a substantially leaktight manner against the inside surface of the body 15, so as to scrape off the composition P that is stuck thereto, as the movable system 30 moves downwardly. The lip 38 may be connected to a central portion 39, thereby forming the shoulder 46, the central portion including, at a bottom end thereof, a wiper lip 140 defining an opening 40 that is configured so that the stem 5 is wiped while the applicator is being removed.

In the exemplary embodiment, the wiper lip 140 may bear in a substantially leaktight manner against the stem 5.

Figure 4:
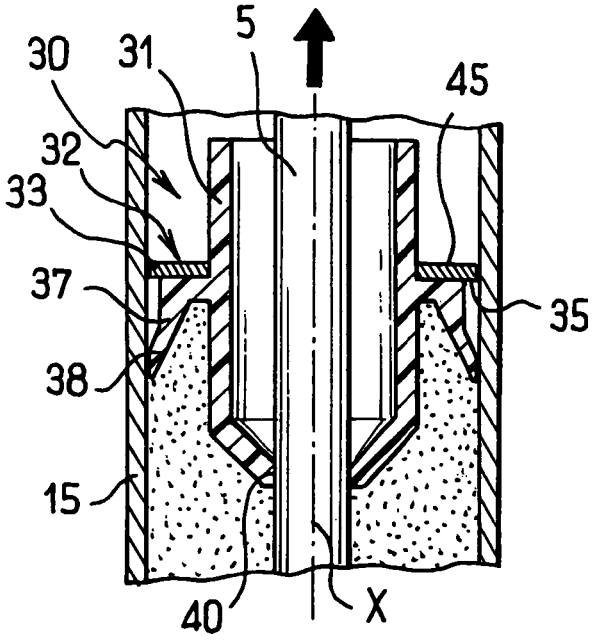
FIG. 4 illustrates the movable system being blocked in the receptacle while the applicator is being removed.

When the wiper member 31 is urged upwardly by removal of the applicator, as illustrated in FIG. 4, the washer 45 may prevent the movable system 30 from rising because the lip 33 is jammed, and thus may bear with greater force against the inside surface of the body 15.

When suction is created in an inside space of the receptacle containing the composition while the applicator is being removed, such suction may also oppose rising of the movable system 30.

In the exemplary embodiment in FIGS. 1 to 4, the washer 45 may bear via an entire outside periphery of the lip 33 against the body 15, so as to oppose rising of the movable system 30.

Figure 6:
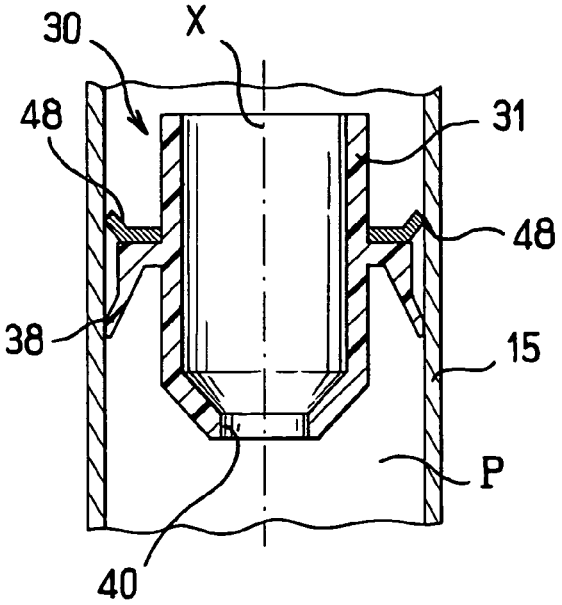
FIG. 6 is a view similar to FIG. 3 of another exemplary embodiment of a movable system.
Figure 7:
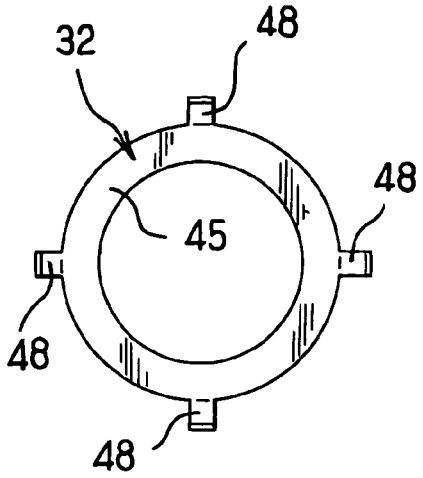
FIG. 7 is a plan view illustrating the blocking element, in isolation.

In other exemplary embodiments, the washer 45 may be extended radially outward by tabs 48, for example, that are four in number, as illustrated in FIGS. 6 and 7. The tabs 48 may be made integrally, i.e., monolithically, with the washer 45, for example, and may slope radially outwardly away from the bottom of the receptacle. The tabs 48 may thus deliver an opposing friction force that is smaller while the movable system 30 is moving down, than while the movable system 30 is trying to rise.

Figure 8:
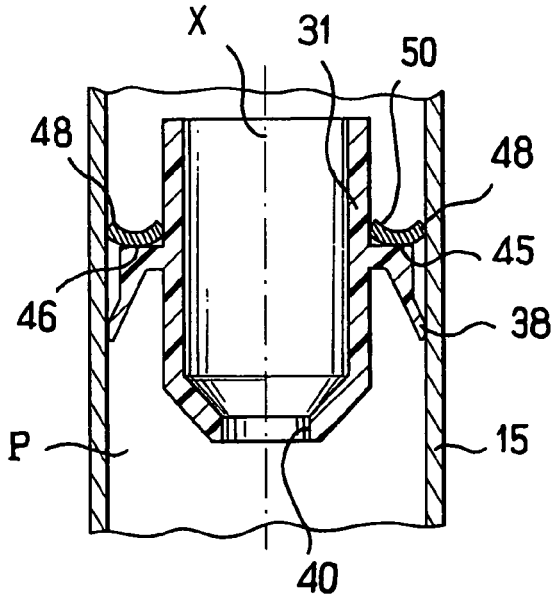
FIG. 8 is a view similar to FIG. 6 of another exemplary embodiment.
Figure 9:
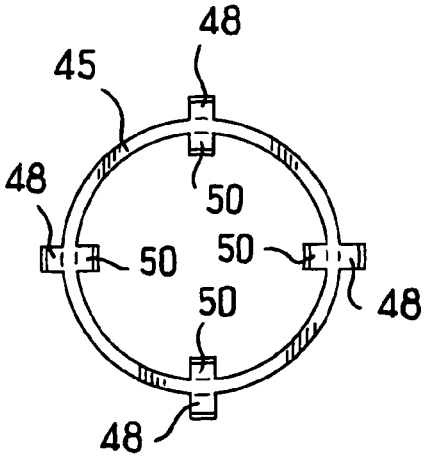
FIG. 9 is a plan view illustrating the blocking element of FIG. 8, in isolation.

In the exemplary embodiment illustrated in FIGS. 8 and 9, the washer 45 may be extended radially outwardly by tabs 48, as in the exemplary embodiment in FIG. 7, but may also be extended radially inwardly by tabs 50 that bear against the central portion 31 of the wiper member, and that may ensure that the washer 45 is held against the shoulder 46.

The anti-return mechanism may also be made in some other way.

Figure 10:
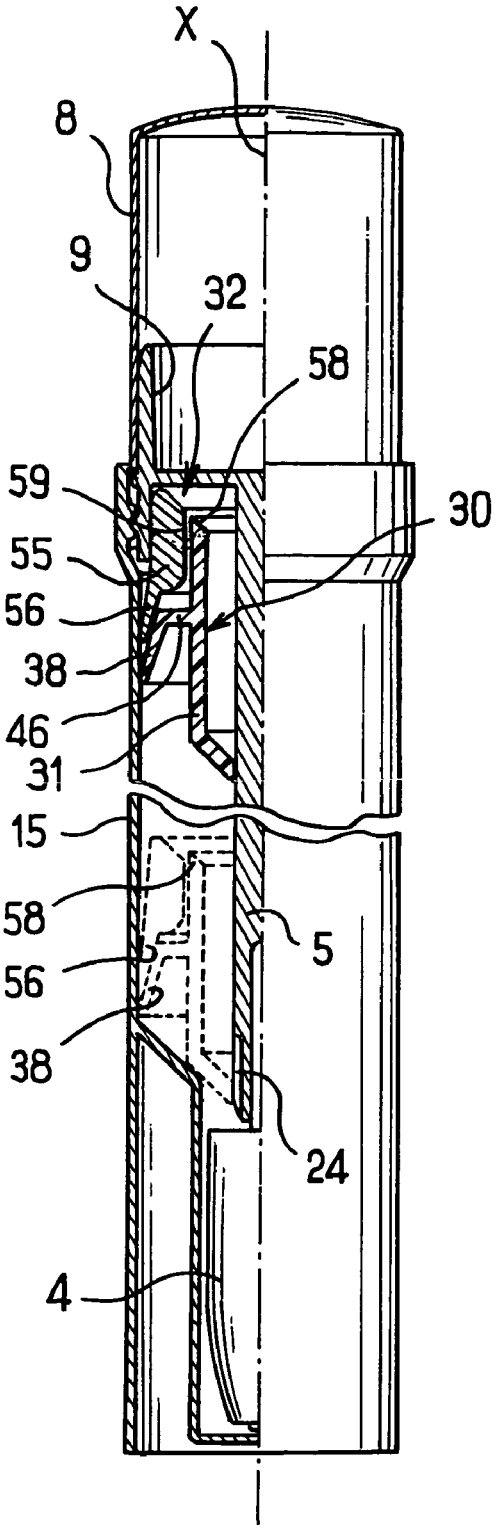
FIGS. 10 to 19 are fragmentary and diagrammatic longitudinal cross-sectional views of other exemplary embodiments.

For example, FIG. 10 illustrates an exemplary embodiment in which the anti-return mechanism 32 comprises a blocking element 55 that is movable relative to the wiper member 31 along the axis X, between a blocking configuration illustrated by dashed lines in FIG. 10, in which an angled portion 56 of the blocking element is interposed between the inside surface of the body 15 and the lip 38 of the wiper member, and an unblocked position in which the blocking element 55 comes to bear via a shoulder against a retention rim 58, formed at the top end of the wiper member.

While the device is being assembled, the blocking element 55 may, for example, be mounted on the wiper member 31 by snap-fastening below the rim 58. Then the movable system 30 may be put into place in the receptacle.

Figure 11:
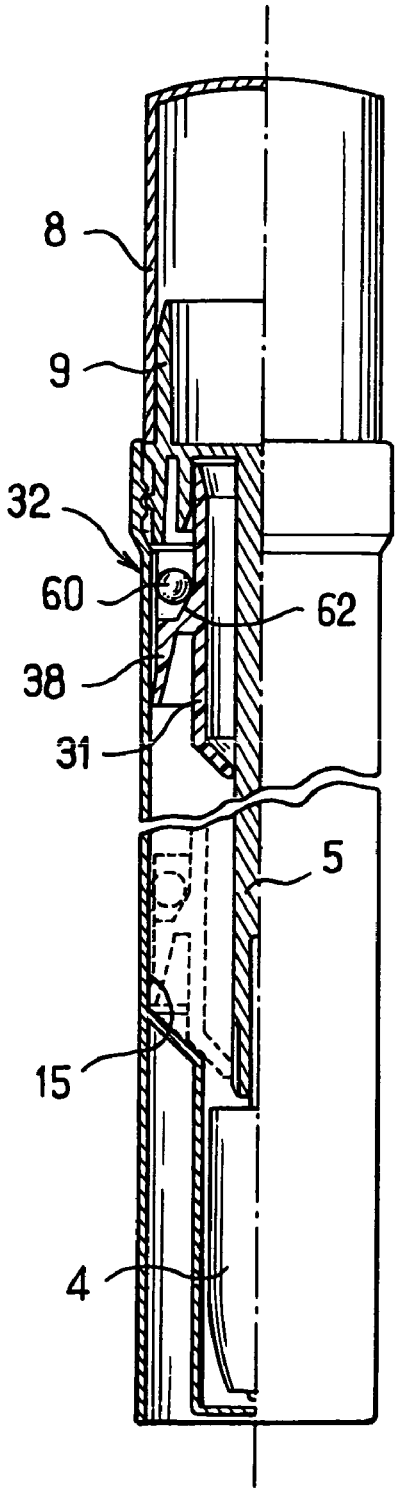

In the exemplary embodiment in FIG. 11, the blocking element 55 is replaced by a ball 60. The wiper member may include a ramp 62 that slopes radially outwardly toward the bottom of the receptacle, such that the ball 60 becomes wedged between the inside surface of the body 15 and the ramp 62 while the wiper member 31 is trying to rise, as illustrated by dashed lines in FIG. 11. The ball 60 may move away from the wall 15 and release the movable system 30 when the wiper member 31 starts to move toward the bottom of the receptacle.

In the exemplary embodiments in FIGS. 10 and 11, the entire blocking element may be movable relative to the wiper member.

As illustrated in FIGS. 12 to 15, at least one blocking element may also be made integrally, i.e., monolithically, with the wiper member by molding a plastics material.

Figure 12:
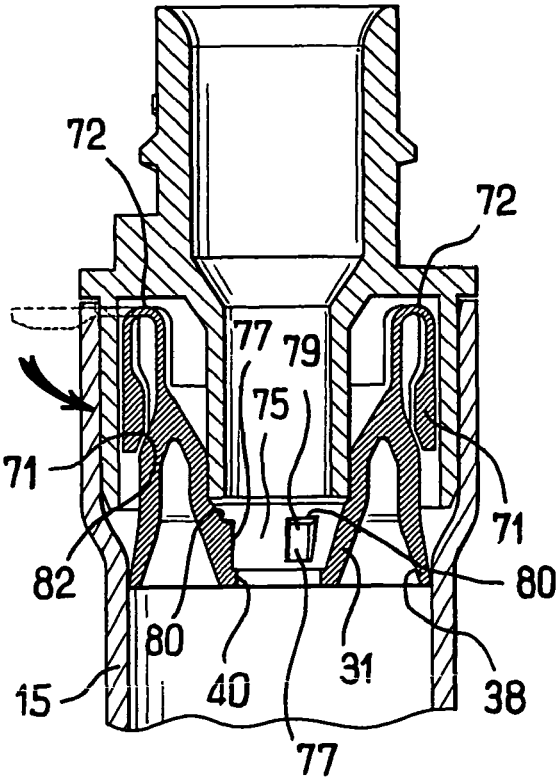
Figure 13:
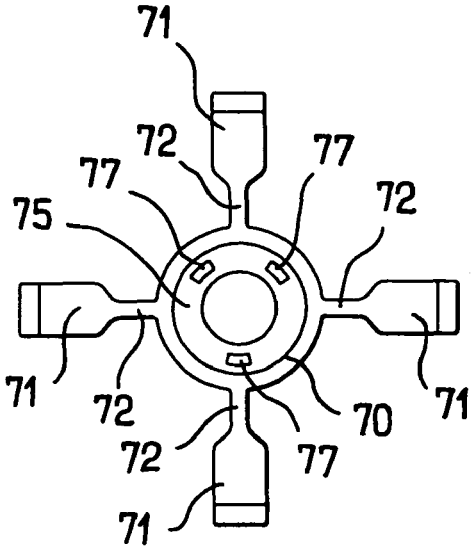

FIGS. 12 and 13 illustrate another exemplary embodiment in which the movable system comprises a wiper member 70, to which four blocking elements 71 are connected by flexible material bridges 72.

The wiper member 70 may include a central portion 75 that is slightly conical on the radially inner surface from which portions in relief 77 project. In the exemplary embodiment, the portions in relief may be three in number. Each of the portions in relief 77 may include a radially inner face 79 that forms a relatively small angle with the region of the central portion 75 that extends between the portions in relief 77, and a top face that defines a step 80 that is more pronounced.

The material bridges 72 may be folded in half during assembly in the receptacle, and each blocking element 71 may include an end that is configured to become wedged, while the movable system is trying to rise, between firstly the body 15, and secondly a ramp 82 formed on the wiper member.

The steps 80 may enable the stem 5 to catch the wiper member while the applicator is being put back into the receptacle, and to urge the movable system 30 to move toward the bottom of the receptacle.

In the exemplary embodiment in FIGS. 12 and 13, the ramp 82 may be disposed in proximity of a junction of the lip 38 with the central portion of the wiper member.

Figure 14:
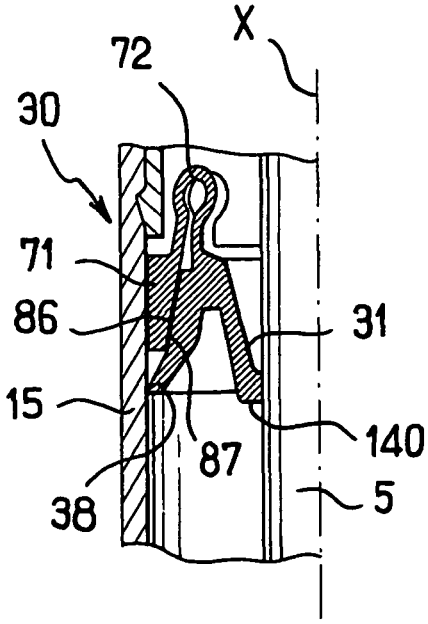

The exemplary embodiment in FIG. 14 differs by a shape of the wiper member 31, a shape of the blocking elements 71, and a shape of the material bridges 72.

Each blocking element 71 may include a radially inner surface 86 that is configured to come to bear against a ramp 87 of the wiper member, so as to become wedged between the lip 38 and the inside surface of the body 15 while the movable system 30 is trying to rise.

Figure 15:
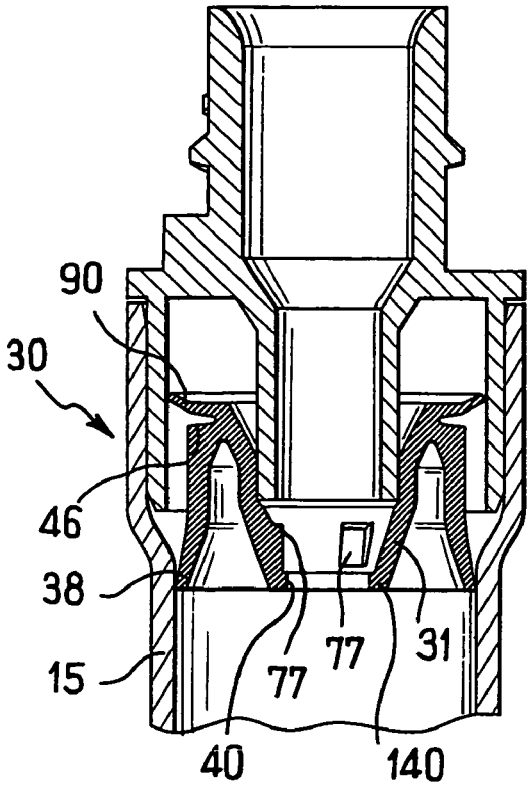

In the exemplary embodiment in FIG. 15, the blocking element may comprise an annular lip 90 that opposes rising of the wiper member 31. The lip 90 may be made integrally, i.e., monolithically, with the wiper member in the top portion thereof, by molding a plastics material. The lip 90 may flex in contact with the body 15 while the movable system is moving down, and may include a curved shape, such that the lip 90 tends to deliver a greater opposing friction force by jamming and by rubbing against the body 15 while the movable system is trying to rise. In addition, the freedom of the lip 90 to flex downwardly in the event of the wiper member trying to rise may be limited by the shoulder 46. In the exemplary embodiment, the lip 90 may be angularly continuous, but, in other exemplary embodiments not illustrated, the lip may be interrupted, being replaced by angularly spaced-apart sectors or tabs.

Figure 16:
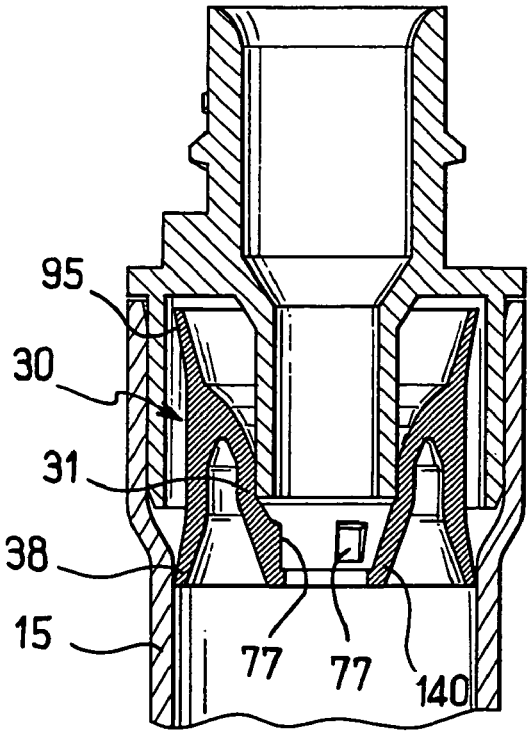

In the exemplary embodiment in FIG. 16, in addition to the lip 38, the wiper member may include a second annular lip 95 on top. The wiper member may bear against the body 15 with friction that is such that the force exerted on the wiper member while the applicator is being removed is insufficient to cause the movable system 30 to rise in the body 15. However, because of the portions in relief 77 on the wiper member, as described above, the force exerted by the applicator while being inserted into the receptacle may be sufficient to cause the movable system 30 to move downwardly when a level of the composition contained in the receptacle is low. The lips 38 and 95 may define an annular groove therebetween.

In the exemplary embodiment in FIG. 16, for example, the lip 140 of the wiper member may bear in a leaktight manner against the stem below the portions in relief 77, so as to enable suction to be created below the wiper member while the applicator is being removed.

Figure 17:
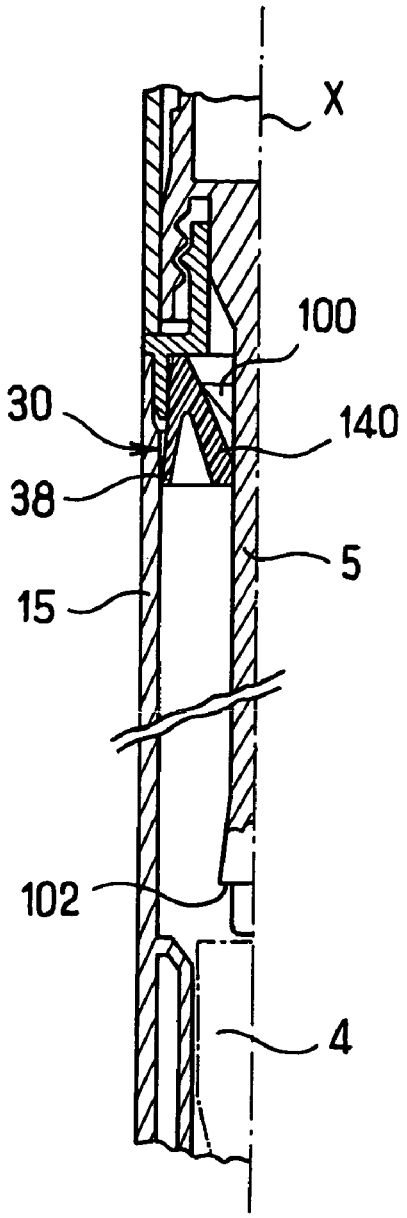
Figure 18:
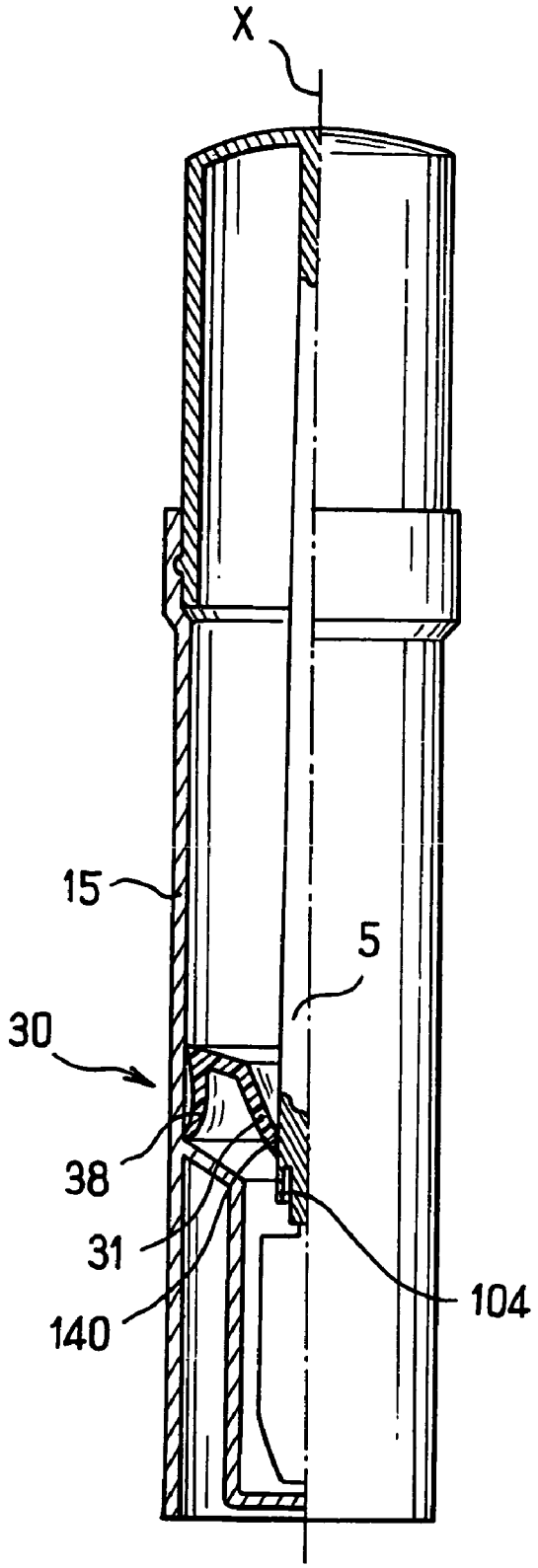

FIGS. 17 and 18 illustrate two other exemplary embodiments of the movable system 30.

In the exemplary embodiment in FIG. 17, the wiper member may include, on a radially inner surface thereof, at least one portion in relief 100 for catching a shoulder 102 of the stem 5 while the stem is being inserted into the receptacle. The shoulder 102 may be disposed in proximity of the applicator element 4.

In the exemplary embodiment in FIG. 18, the bottom end of the stem may be provided with a lip 104 that is configured to exert a greater force on the wiper member 31 while the applicator is being put back into the receptacle, than while the applicator is being removed, thus causing the wiper member to move downwardly.

Figure 19:
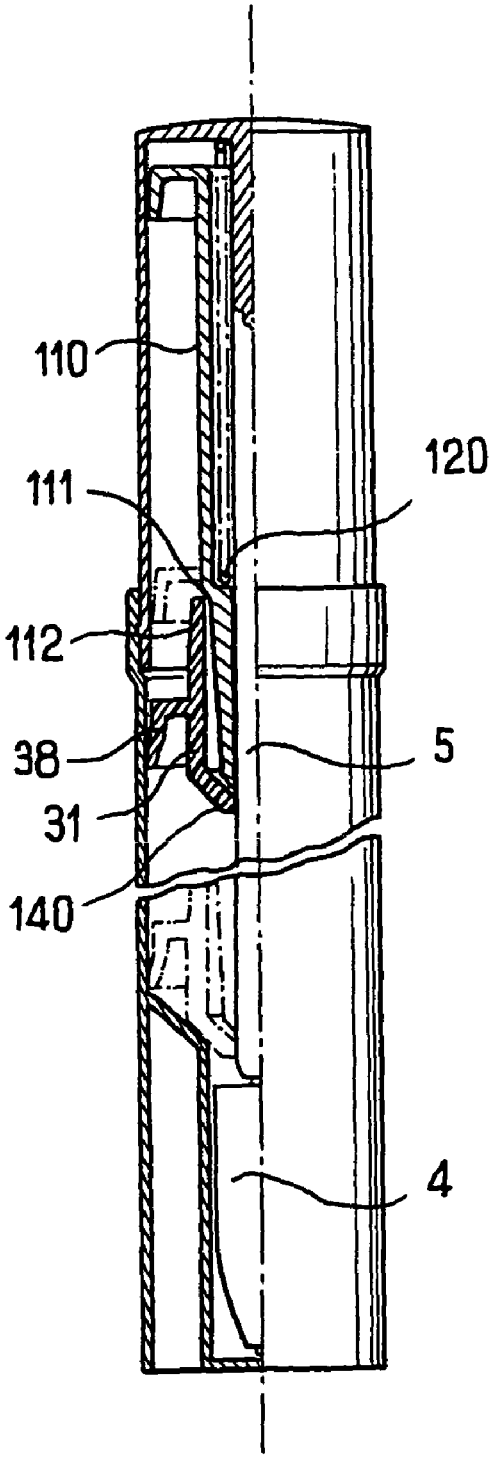
Figure 20:
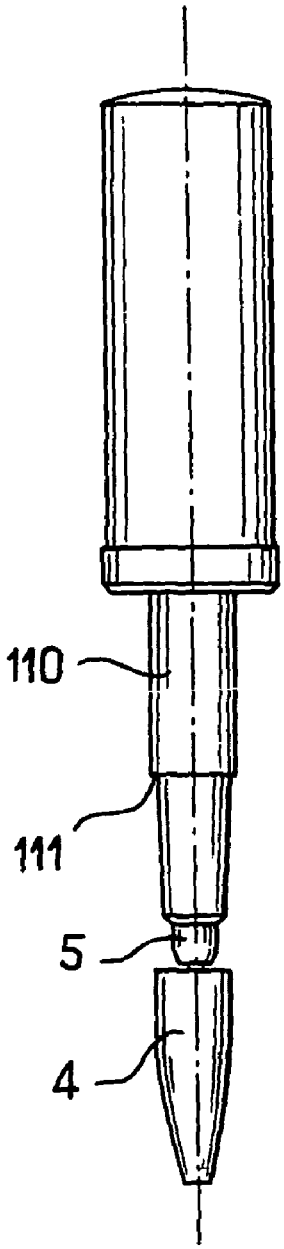
FIG. 20 illustrates the applicator of the device of FIG. 19, after being removed from the receptacle.

In the exemplary embodiment in FIGS. 19 to 20, the applicator may include a movable portion 110 that includes a shoulder 111 that is configured to bear against the top end 112 of the wiper member when the applicator is in place in the receptacle, as illustrated in FIG. 19. The movable portion 110 may slide along the stem 5 of the applicator against a return action of a spring 120 that is urged toward the movable portion 110 of the applicator element 4. At a top end thereof, the spring 120 may bear against a wall that defines the top of the handle, and at a bottom end thereof, the spring 120 may bear against an internal shoulder of the movable portion 110. When the applicator is placed in the receptacle, the movable portion 110 may bear against the wiper member 31, with a predefined force that depends on the compression of the spring 120. As the receptacle empties, the wiper member may move down inside the receptacle under the action of the spring 120 that relaxes.

Naturally, the invention is not limited to the exemplary embodiments described above. For example, characteristics of the exemplary embodiments may be combined with one another in exemplary embodiments that are not illustrated.

Although various details of the present invention herein have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

The expression "comprising a" should be understood as being synonymous with "comprising at least one", unless specified to the contrary.

What is claimed is:

1. A packaging and applicator device comprising:

a receptacle for containing a composition to be applied; and an applicator including an applicator element that is configured to be inserted into the receptacle for taking the composition;

the receptacle comprising:

a body; and a movable system that is movable inside the body, the movable system including a wiper member that includes only one opening through which the applicator element passes while the applicator element is being inserted into the receptacle, and an anti-return mechanism comprising at least one blocking element that bears against the body of the receptacle with a coefficient of friction that is smaller while the movable system is moving toward a bottom of the receptacle, than while the movable system is moving away from the bottom of the receptacle to oppose movement of the movable system in a direction away from the bottom of the receptacle, wherein the movable system is configured so as to move in a generally unidirectional manner toward a bottom of the receptacle based on a force exerted by the applicator during insertion of the applicator into the receptacle.

2. A device according to claim 1, wherein the blocking element comprises a portion that is stationary relative to the wiper member.

3. A device according to claim 1, wherein the blocking element comprises a portion that is movable as a whole relative to the wiper member.

4. A device according to claim 1, wherein the blocking element includes at least one of a lip and a tab that bears against the body of the receptacle, and that slopes outward, away from the bottom of the receptacle.

5. A device according to claim 4, wherein the at least one lip or tab is carried by a washer.

6. A device according to claim 1, wherein the blocking element is configured to become wedged between the wiper member and the body of the receptacle while the movable system attempts to move away from the bottom of the receptacle.

7. A device according to claim 6, wherein the blocking element comprises at least one ball that is configured to bear against the body and against a ramp of the movable system while the movable system attempts to move away from the bottom of the receptacle, the ramp sloping inward, away from the bottom of the receptacle.

8. A device according to claim 6, wherein the blocking element comprises at least one angled portion that is configured to become wedged between the body of the receptacle and the wiper member while the movable system attempts to move away from the bottom of the receptacle.

9. A device according to claim 1, wherein the movable system includes at least one portion in relief that is configured, while being passed over by the applicator, to deliver an opposing force that is greater while the applicator is being inserted into the receptacle, than while the applicator is being removed.

10. A device according to claim 1, wherein the wiper member includes at least one portion in relief that is configured, while being passed over by the applicator, to deliver an opposing force that is greater while the applicator is being inserted into the receptacle, than while the applicator is being removed.

11. A device according to claim 1, wherein the force exerted by the applicator on the movable system while the applicator is being inserted into the receptacle is greater than a friction force existing between the movable system and the body of the receptacle, the friction force being greater than a force exerted by the applicator on the movable system while the applicator is being removed, such that, during removal, the movable system is substantially stationary.

12. A device according to claim 1, the applicator including a stem, wherein the stem does not include a portion in relief configured to cooperate with the movable system.

13. A device according to claim 1, the applicator including a stem, wherein the stem includes at least one portion in relief that is configured to co-operate with the movable system, in such a manner that the force exerted by the applicator on the movable system is greater while the applicator is being inserted into the receptacle, than while the applicator is being removed.

14. A device according to claim 13, wherein the stem includes at least one annular lip that is oriented toward the bottom of the receptacle.

15. A device according to claim 13, wherein the stem includes at least one shoulder.

16. A device according to claim 1, wherein the wiper member bears against the body of the receptacle via at least two spaced-apart peripheral portions, without bearing against the body between the two portions.

17. A device according to claim 1, wherein the wiper member is made monolithically with at least one of a lip and a tab that bears against the body of the receptacle, the lip or tab being configured to flex freely while the movable system moves toward the bottom of the receptacle and is prevented from flexing in an opposite direction by the wiper member.

18. A device according to claim 1, wherein the applicator includes a movable portion that is configured to move away from the applicator element against an action of a return member, the movable portion being configured to come to bear against the movable system.

19. A device according to claim 1, wherein the bottom portion of the receptacle includes a well of inside section that matches the applicator element.

20. A device according to claim 19, wherein a top of the well is connected to a frustoconical wall.

21. A device according to claim 1, wherein the applicator includes a stem, and wherein the wiper member bears in a leaktight manner against at least one portion of the stem.

22. A device according to claim 1, wherein the movable system bears in a leaktight manner against at least one portion of the body of the receptacle.

23. A device according to claim 8, wherein the portion is made monolithically with the wiper member, and wherein the portion is connected to the wiper member by a flexible material bridge.

24. A device according to claim 8, wherein the wiper member comprises at least three angled portions.

* * * * *